US005347890A

United States Patent [19]

Rufkahr

[11] Patent Number: 5,347,890

[45] Date of Patent: Sep. 20, 1994

[54] TOP PULLER

[76] Inventor: Bernard O. Rufkahr, 30 Old Forge, St. Charles, Mo. 63301

[21] Appl. No.: 68,154

[22] Filed: May 28, 1993

[51] Int. Cl.[5] ..... B67B 7/40
[52] U.S. Cl. ..... 81/3.55
[58] Field of Search ..... 81/3.07, 3.4, 3.55, 81/3.57, 3.09

[56] References Cited

U.S. PATENT DOCUMENTS

| | | | |
|---|---|---|---|
| 2,548,517 | 4/1951 | Clark | 81/3.57 |
| 4,869,134 | 9/1989 | Sprecher | 81/3.55 |
| 4,919,016 | 4/1990 | Hanegraaf | 81/3.55 |

*Primary Examiner*—Roscoe V. Parker
*Attorney, Agent, or Firm*—Polster, Lieder, Woodruff & Lucchesi

[57] ABSTRACT

A puller for removing the scored portion from "easy open" beverage cans which can be positioned on the finger of the user and has a hook portion for engaging the ring on the can top.

1 Claim, 1 Drawing Sheet

TOP PULLER

BACKGROUND OF THE INVENTION

This invention relates to the art of removing pull tops from beverage cans, food cans and the like, and particularly relates to those "easy open" cans that have scored openings and a pull tab attached thereto which is normally grasped between the fingers of the user and pulled toward the rim of the can to affect removal of the scored portion.

It is well known that the pull off portion of can tops may have sharp edges on both the removable tab and the remaining portion of the can, and often it is difficult for the user to remove the tab portion from the can because of lack of strength, and/or improperly scored tops, etc. Many taverns utilize metal cans to dispense beer and soda, and, contrary to most of the world, in the United States a substantial portion of the beverages sold over the counter are sold in cans, and most of these cans have some sort of "easy open" top. It is a common complaint of bartenders and persons who must open numerous cans, including campers who utilize food from cans with pull top openers, that these tabs often break finger nails or cause cuts, etc., on the fingers of the user.

In opening a conventional pull top can, the user must grasp a ring between two fingers and pull the ring toward the rim of the can. This requires considerable strength in the fingers and does not enable the user to utilize the heavier arm muscles. It also requires that the fingers be in close proximity to the metal which sometimes causes cuts to the hand of the user.

SUMMARY OF THE INVENTION

Accordingly, one of the principal objects of the present invention is to provide a device which can be placed over the first or middle finger of the wearer and has means for grasping the ring of a pull top can such that the entire force of the user's arm can be applied to pull the top from the can and thus open the can.

Another principal object of this invention is to provide a device that can be varied in size so as to be utilized by persons who have different size fingers without necessitating a plurality of sizes for the device.

Still a further object of the present invention is to provide a can top puller which can be applied to the finer of a user and allows the removable portion of the top to be removed from a can without the user touching the ring or the can top.

Still another object is to provide a top puller which can be applied to a finger of a user and can be worn without interfering with the normal operation or functioning of the hand of the wearer. These and other objects and advantages will become apparent hereinafter.

DESCRIPTION OF THE DRAWINGS

In the drawings wherein like numbers refer to like parts wherever they occur.

DETAILED DESCRIPTION

Figure 1:
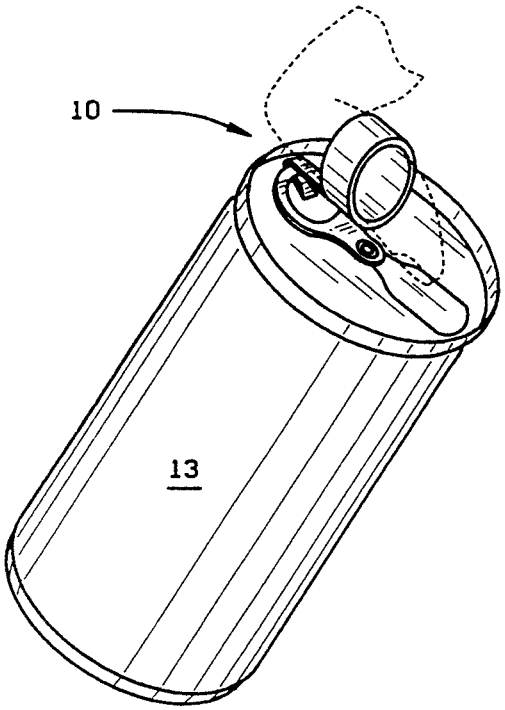
FIG. 1 is a fragmentary perspective view showing the present invention being used to remove a pull top from a can.

FIG. 1 shows the top puller 10 mounted on the finger of a user and engaging the ring or pull portion 11 of a removable pull top 12. The top 12 is fastened onto a can body 13, and in use, the can 13 is normally grasped with the other hand of the user.

Figure 2:
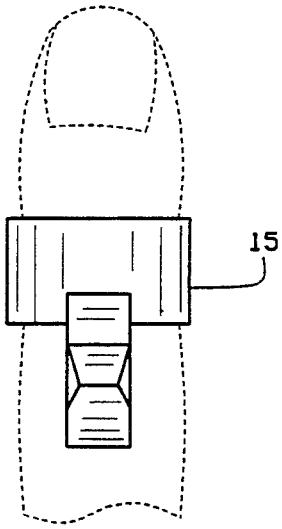
FIG. 2 is a plan view showing the present invention applied to a finger of a user.
Figure 3:
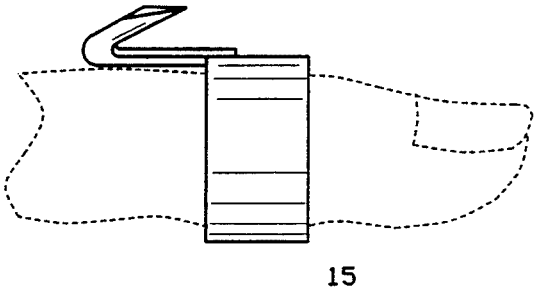
FIG. 3 is a side view similar to FIG. 2.
Figure 4:
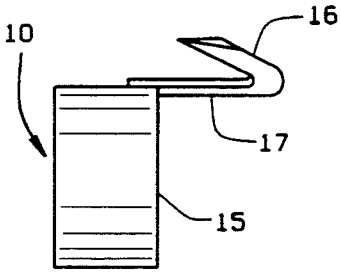
FIG. 4 is a side elevational view of the puller of this invention.
Figure 5:
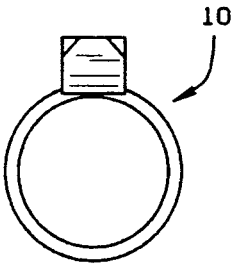
FIG. 5 is an end elevational view of the puller shown in FIG. 4.

The top puller 10 (FIGS. 4 and 5) comprises a finger engaging cylindrical ring portion 15 and a reversely curved hook portion 16. The ring portion 15 is open at both ends and is adapted to be slipped over the end of the first or middle finger of a user (FIGS. 2 and 3) past the first joint and to be frictionally engaged there during use. Preferably, the ring 15 and hook 16 are of one piece molded construction and may be formed from any suitable polymeric formulation such as polyethylene or polypropylene. The hook portion 16 has a forwardly extending stem 17 which is tangent to and integrally associated with the ring 15 and is extended toward the top of the user's finger upon which the ring 15 is mounted. The stem 17 terminates in the reversely curved dependent hook 16 which is adapted to engage the ring portion 11 of the pull top 12, and which extends backwardly toward the cylindrical ring portion 15. The hook 16 terminates in a tapered point to assist it in being slipped under and into engagement with the removable top ring 11.

In use, the ring portion 15 is inserted over the first or middle finger of the user and turned to the outside of the hand away from the palm portion, thereby freeing the hand area for normal use. When the fingers of the user are bent inwardly, the hook portion 16 is exposed and locked in place. When the hook 16 is engaged with the ring 11 of a pull top 12, the pull tab 11 is removed from the top 12 merely by moving the hand and arm of the user toward his body. The finger is locked in position so that any stress is carried by the arm and hand. Thus, it is seen that the fingers of the user never engage the can top or pull tab, eliminating the possibility of the user cutting himself if the fingers were to slip off the ring 11. Also the finger strength required is minimal.

Figure 6:
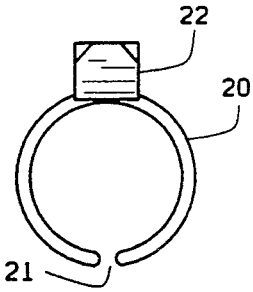
FIG. 6 is an end elevational view of a modification of the present invention adapted for universal application to all size fingers.

A modification of the present invention is shown in FIG. 6 and involves a universal semicylindrical ring portion 20 which has a slot 21 formed opposite the stem and hook 22. This allows the ring portion 20 to adapt itself to fingers of different diameters and sizes. This eliminates the necessity for making many molds and keeping a large supply of top pullers on hand to accommodate the hands of different users.

Thus, it is seen that the present invention achieves all of the advantages and objects sought therefore.

What is claimed is:

1. A one piece molded polymeric device for removing removable portions of tops from receptacles comprising a substantially cylindrical ring portion for engaging the finger of a user, the cylindrical ring being open at both ends such that the finger of the user passes completely through the ring and frictionally engages the finger past the first joint, and an integral stem and hook for engaging a ring on the removable portion of the receptacle top, the stem extending parallel to the centerline of the cylinder and back toward the hand of the user and being tangent to the ring, and the hook depending from the stem outside the cylinder formed by the ring, the hook having a reversely curved portion extending backwardly toward the ring portion and aligned with the stem, the reversely curved portion of the hook being relatively flat and terminating in a tapered flat nose, the nose being the end of the device, the ring being provided with a cutout section along its length circumferentially opposed to the stem and hook so as to be semi-cylindrical in cross section to accommodate the user's fingers of differing thickness and diameter, the end of the user's fingers being completely exposed and uncovered.

* * * * *